US011634274B2

(12) United States Patent
Shepherd et al.

(10) Patent No.: US 11,634,274 B2
(45) Date of Patent: Apr. 25, 2023

(54) BULK FLUID STORAGE CONTAINER

(71) Applicant: SandBox Logistics, LLC, Houston, TX (US)

(72) Inventors: Justin M. Shepherd, Houston, TX (US); Daniel Miers, Galveston, TX (US)

(73) Assignee: SANDBOX ENTERPRISES, LLC, Katy, TX (US)

( * ) Notice: Subject to any disclaimer, the term of this patent is extended or adjusted under 35 U.S.C. 154(b) by 163 days.

(21) Appl. No.: 16/825,608

(22) Filed: Mar. 20, 2020

(65) Prior Publication Data

US 2020/0299057 A1 Sep. 24, 2020

Related U.S. Application Data

(60) Provisional application No. 62/822,446, filed on Mar. 22, 2019.

(51) Int. Cl.
*B65D 88/54* (2006.01)
*B65D 88/02* (2006.01)
(Continued)

(52) U.S. Cl.
CPC ..... *B65D 88/54* (2013.01); *B65D 88/022* (2013.01); *B65D 88/128* (2013.01); *B65D 88/52* (2013.01);
(Continued)

(58) Field of Classification Search
CPC .... B65D 88/54; B65D 88/022; B65D 88/128; B65D 90/0033; B65D 90/10; B65D 90/34; B65D 90/48; B65D 90/52; B65D 2588/12; B65D 88/027; B65D 88/52; B65D 90/16; B65D 90/18; B65D 90/623
See application file for complete search history.

(56) References Cited

U.S. PATENT DOCUMENTS 4,599,040 A 7/1986 Rasmussen
4,613,053 A * 9/1986 Kimura ..... B65D 88/121 220/530
(Continued)

FOREIGN PATENT DOCUMENTS

CA 2889959 11/2015
DE 203 20 972 U1 9/2005
(Continued)

*Primary Examiner* — Frederick C Nicolas
(74) *Attorney, Agent, or Firm* — Osha Bergman Watanabe & Burton LLP

(57) ABSTRACT

A bulk fluid storage container has a top wall structure and a bottom wall structure held in spaced relation by a side wall structure. An internal baffle assembly is disposed in the fluid storage volume between the side wall structure for reducing fluid sloshing. A fill port formed in the top wall structure has a fill flange for coupling with a source of the fluid. A vent port formed in the top wall structure has a pressure vacuum value. A drain port formed in the side wall structure in a lower region adjacent the gutter region has a drain valve assembly is coupled to the drain port. A frame assembly includes an upper rectangular frame member and a lower rectangular frame member arranged in spaced relation by a plurality of post; wherein the frame assembly surrounds and supports the fluid storage vessel.

19 Claims, 12 Drawing Sheets

(51) Int. Cl.

| | |
|---|---|
| ***B65D 88/12*** | (2006.01) |
| ***B65D 90/00*** | (2006.01) |
| ***B65D 90/10*** | (2006.01) |
| ***B65D 90/34*** | (2006.01) |
| ***B65D 90/48*** | (2006.01) |
| ***B65D 90/52*** | (2006.01) |
| ***B65D 90/16*** | (2006.01) |
| ***B65D 90/18*** | (2006.01) |
| ***B65D 88/52*** | (2006.01) |
| ***B65D 90/62*** | (2006.01) |

(52) U.S. Cl.

CPC ..... *B65D 90/0033* (2013.01); *B65D 90/10* (2013.01); *B65D 90/16* (2013.01); *B65D 90/18* (2013.01); *B65D 90/34* (2013.01); *B65D 90/48* (2013.01); *B65D 90/52* (2013.01); *B65D 90/623* (2013.01); *B65D 88/027* (2013.01); *B65D 2588/12* (2013.01)

(56) References Cited

U.S. PATENT DOCUMENTS

| | | | | |
|---|---|---|---|---|
| 4,679,979 | A | 7/1987 | Rasmussen | |
| 4,690,608 | A | 9/1987 | Rasmussen | |
| 5,115,943 | A * | 5/1992 | Coleman | B65D 77/061 222/94 |
| 5,534,138 | A | 7/1996 | Coale | |
| 5,582,311 | A | 12/1996 | Bartenstein | |
| 5,624,049 | A | 4/1997 | Kovash et al. | |
| 5,678,978 | A | 10/1997 | Markham | |
| 5,938,065 | A | 8/1999 | De Vivo et al. | |
| D417,171 | S | 11/1999 | Satterfield et al. | |
| 6,152,492 | A | 11/2000 | Markham et al. | |
| 6,173,991 | B1 | 1/2001 | Piona et al. | |
| 6,354,787 | B1 | 3/2002 | O' Daniel | |
| 6,364,153 | B1 | 4/2002 | Petzitillo, Jr. et al. | |
| D557,178 | S | 12/2007 | Petzitillo, Jr. et al. | |
| 7,736,106 | B2 | 6/2010 | Talbot et al. | |
| 7,762,588 | B2 | 7/2010 | Markham | |
| 7,780,383 | B2 | 8/2010 | Brescia | |
| 7,789,256 | B2 | 9/2010 | Petzitillo, Jr. et al. | |
| 7,815,222 | B2 | 10/2010 | Markham | |
| 7,997,441 | B2 | 8/2011 | Marcel | |
| 8,261,930 | B2 | 9/2012 | Satterfield et al. | |
| D678,127 | S | 3/2013 | Markham | |
| 8,523,233 | B2 | 9/2013 | Markham | |
| 8,646,641 | B2 * | 2/2014 | Moir | B65D 88/128 220/23.91 |
| 9,150,349 | B2 | 10/2015 | Hall et al. | |
| 9,205,883 | B2 | 12/2015 | Bennett et al. | |
| 9,481,513 | B2 | 11/2016 | Warren et al. | |
| D819,778 | S | 6/2018 | Polacek et al. | |
| 10,040,386 | B2 | 8/2018 | Trueman | |
| 10,538,382 | B2 | 1/2020 | Petzitillo, Jr. | |
| 2006/0032854 | A1 * | 2/2006 | Schutz | B65D 1/46 220/562 |
| 2007/0199937 | A1 * | 8/2007 | Schutz | A62C 2/065 220/23.91 |
| 2009/0242576 | A1 | 10/2009 | Marcel | |
| 2010/0013206 | A1 | 1/2010 | Markham | |
| 2010/0013207 | A1 | 1/2010 | Markham | |
| 2010/0320727 | A1 | 12/2010 | Haut et al. | |
| 2011/0121003 | A1 | 5/2011 | Moir | |
| 2012/0305553 | A1 | 12/2012 | Brotzell et al. | |
| 2013/0084159 | A1 | 4/2013 | Warren et al. | |
| 2015/0233745 | A1 | 8/2015 | Kumar | |
| 2015/0360857 | A1 * | 12/2015 | Oren | B65D 88/26 414/288 |
| 2015/0369647 | A1 | 12/2015 | Kumar et al. | |
| 2016/0311376 | A1 | 10/2016 | Dokter et al. | |
| 2016/0318707 | A1 | 11/2016 | Markham | |
| 2017/0361754 | A1 | 12/2017 | Trueman | |
| 2018/0241291 | A1 | 8/2018 | Mou | |
| 2018/0251291 | A1 | 9/2018 | Markham | |
| 2018/0252083 | A1 | 9/2018 | Hardin et al. | |
| 2018/0290826 | A1 | 10/2018 | Polacek et al. | |
| 2018/0305141 | A1 | 10/2018 | Markham | |
| 2019/0061597 | A1 | 2/2019 | Markham | |

FOREIGN PATENT DOCUMENTS

| | | | |
|---|---|---|---|
| WO | 2006009511 | A1 | 1/2006 |
| WO | 2014/114197 | A1 | 7/2014 |

* cited by examiner

BULK FLUID STORAGE CONTAINER

CROSS-REFERENCE TO RELATED APPLICATIONS

This application claims the benefit of U.S. Provisional Application No. 62/822,446, filed on Mar. 22, 2019.

TECHNICAL FIELD

The present disclosure relates generally to a bulk storage container, and more particularly relates to a fluid storage tank for the transport and storage of fluids used in the oil and gas industry, namely water used in the hydraulic fracturing process.

BACKGROUND

This section provides background information related to the present disclosure which is not necessarily prior art.

Hydraulic fracturing is a well stimulation technique in which rock is fractured by a pressurized liquid. The process involves the high-pressure injection of a 'fracking fluid' (primarily water, containing sand or other proppants suspended with the aid of thickening agents) into a wellbore to create cracks in the deep-rock formations through which natural gas, petroleum, and brine will flow more freely. When the hydraulic pressure is removed from the well, small grains of hydraulic fracturing proppants, such as sand or aluminum oxide, hold the fractures open.

The hydraulic fracturing process requires the transportation and storage of various resources at the well-site which is consumed during the fracturing process. Recent efforts have focused on improved logistics including containerization solutions primarily directed to proppant storage, handling and well-site delivery. Little attention has been paid to improved logistics relating to the storage, handling and well-site delivery of fluids used in the hydraulic fracturing process.

Accordingly, there is a need to provide suitable, cost effective solution for the transportation and storage of fluids used in the oil and gas industry.

BRIEF DESCRIPTION OF THE DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
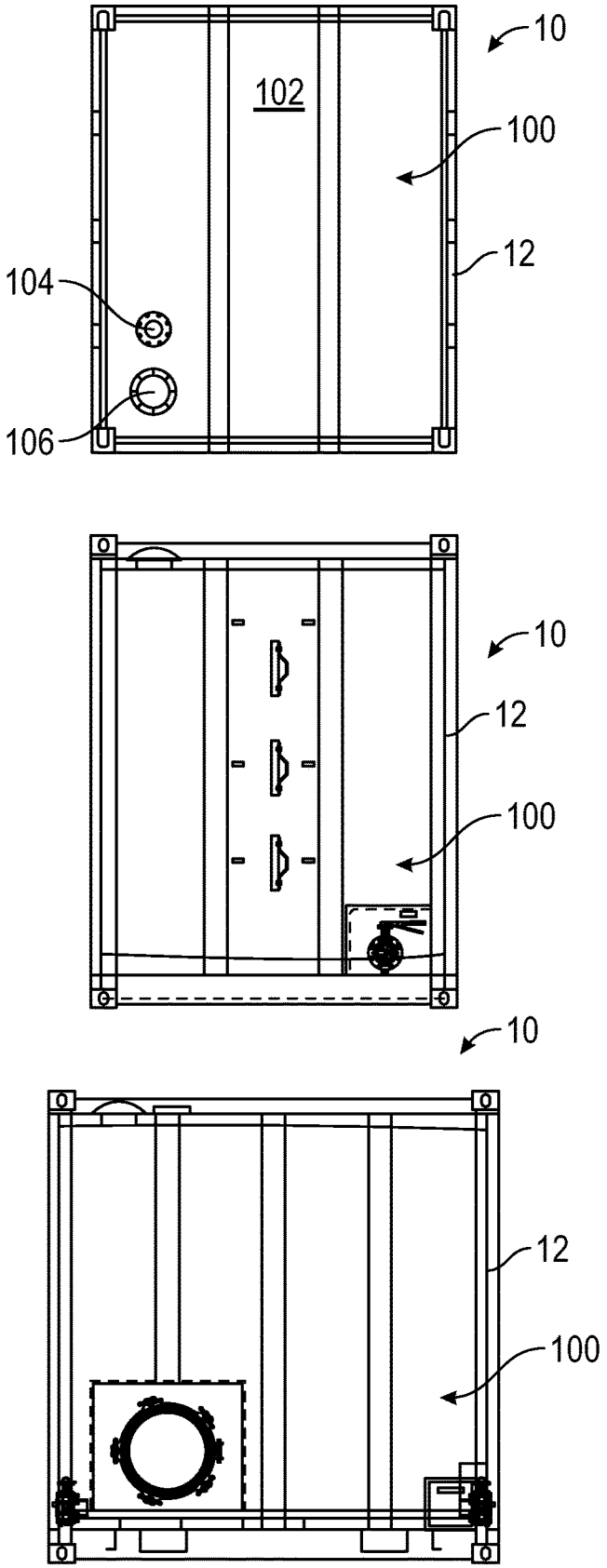
FIG. 1 is a multi-view drawing of a bulk fluid storage container in accordance with the present disclosure showing a top view, a right side elevation and a front elevation.
Figure 2:
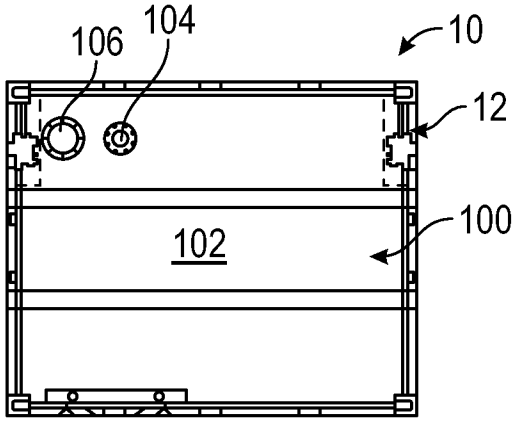
FIG. 2 is a top view of the fluid bulk storage container shown in FIG. 1.
Figure 3:
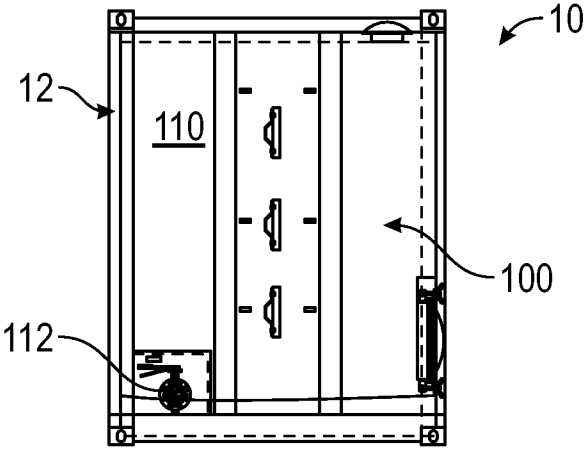
FIG. 3 is a left side elevation of the bulk fluid storage container shown in FIG. 1.
Figure 4:
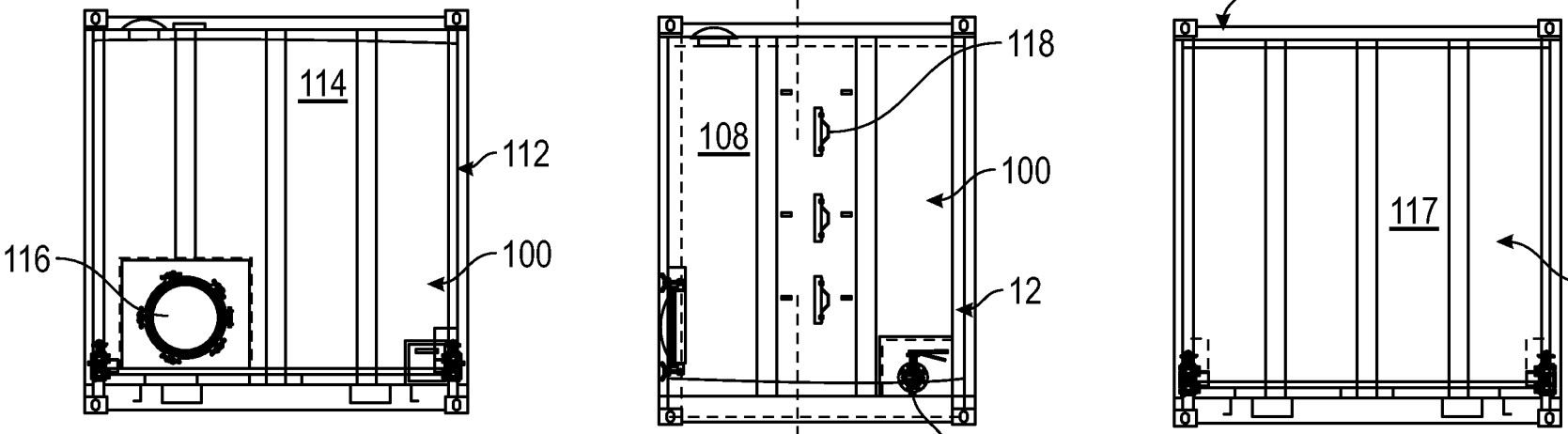
FIG. 4 is a front elevation of the bulk fluid storage container shown in FIG. 1.
Figure 5:
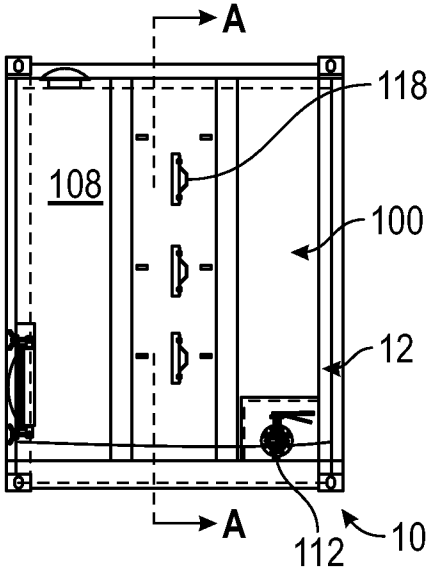
FIG. 5 is a right side elevation of the bulk fluid storage container shown in FIG. 1.
Figure 6:
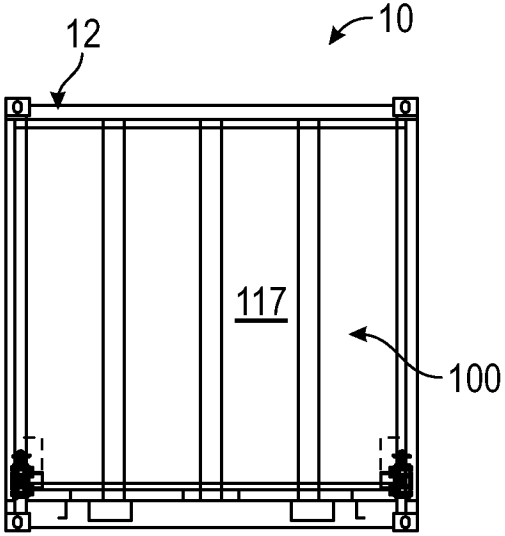
FIG. 6 is rear elevation of the bulk fluid storage container shown in FIG. 1.

The following detailed description is merely exemplary in nature and is not intended to limit the invention or the application and uses of the invention. Furthermore, there is no intention to be bound by any theory presented in the preceding background of the invention or the following detailed description.

In accordance with the present disclosure, a bulk fluid storage container is described and illustrated which facilitates the storage and transport of fluid material such as water at a well-site. With reference to FIGS. 1-6, a bulk fluid storage container 10 includes a frame assembly 12 surrounding, supporting and reinforcing a fluid storage vessel 100. A top 102 of the fluid storage vessel 100 is provided with a flanged fill port 104 and a pressure vacuum valve 106, which will be described in further detail below. The right side 108 and the left side 110 of the fluid storage vessel 100 are provided with a drain valve assembly 112, which will be described in further detail below. The front side 114 of the fluid storage vessel 100 is provided with a manway block 116, which will be described in further detail below, for accessing an interior volume thereof. The back side 117 of the fluid storage vessel 100 is also provided. An internal baffle assembly 118, which will be described in further detail below, is secured within the interior volume of the fluid storage vessel 100. The bulk fluid storage container 10, and more particularly the frame assembly 12 includes a pair of tubular cross-members 14 (best seen in FIG. 24) configured to receive the tines of a lifting fork such as found on a pallet jack or forklift truck. The bulk fluid storage container 10 may additionally or alternatively include transport coupling members for releasably attaching the bulk fluid storage container 10 to other load transfer or container handling machinery used for lifting, moving, positioning and placing bulk storage containers.

The bulk fluid storage container 10 is preferably sized to be readily stowed and transported on conventional transport vehicles used in commercial roadway systems, railroad systems or fluid supply/discharge stations. In this regard, the bulk fluid storage container is sized to be efficiently loaded onto a flatbed trailer or railcar. For example, the bulk fluid storage container 10 and in particular the frame assembly 12 which surrounds the fluid storage vessel 100 may have an overall length (side to side) of about 10 feet, an overall width (front to back) of about 8 feet and an overall height (top to bottom) of about 10 feet. In this configuration, the fluid storage vessel 100 has an interior volume having a fluid capacity of about 4850 gallons or about 115 barrels.

The bulk fluid storage container 10 is fabricated of suitably rigid materials which has been properly treated for safely storing the desired fluid. For water storage purposes, the frame assembly 12 may be fabricated using welded steel components having a nominal wall thickness of 3/16", and the fluid storage vessel 100 may be fabricated using 3/16" A36 steel plate components which are welded together. The frame assembly 12 and the fluid storage vessel 100 may be prepped using a commercial sand blasting process, then finished using a DTM polyurethane paint.

Figure 8:
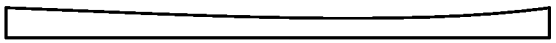
FIG. 8 is a detail of item J shown in the right side elevation illustrated in FIG. 7.
Figure 9:
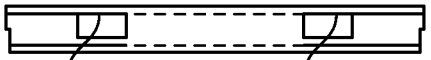
FIG. 9 is a detail of item E shown in the front elevation illustrated in FIG. 7.
Figure 10:
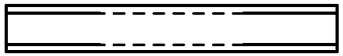
FIG. 10 is a detail of item E shown in the right side elevation illustrated in FIG. 7.
Figure 7:
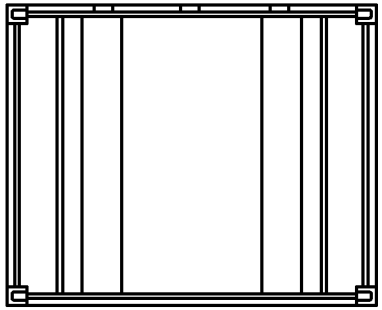
FIG. 7 is a multi-view drawing illustrating a frame assembly of the bulk storage container shown in FIG. 1.
Figure 7:
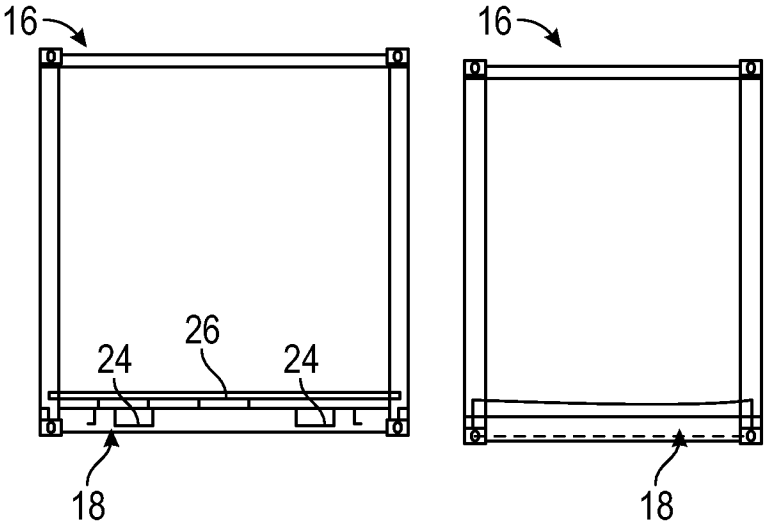

With reference now to FIGS. 7-10, the components of the frame assembly 12 includes a rectangular upper frame 16 formed with a pair of longitudinal header (A), and a pair of transverse header (B) and a rectangular lower frame 18 formed with a pair of longitudinal beams (E) and a pair of transverse beams (F). A plurality of joists (J) are evenly spaced on and supported between the pair of longitudinal beams (E). As best seen in FIG. 8, the upper edge 20 of the joist (J) is pitched towards low point 22 between the ends of the joist (J). The upper and lower frame members 16, 18 are supported in a spaced relationship by posts (C) to form a generally rectangular cuboid. The longitudinal headers (A), transverse headers (B) and posts (C) may be formed using square or rectangular tubular steel stock. As best seen in FIGS. 9 and 10, the longitudinal beams (E) and the transverse beams (F) may be formed as channel steel stock having a generally C-shaped cross-section. The longitudinal beams (E) have a pair of rectangular apertures 24 formed in the side wall. The tubular cross-members 14 are aligned with the rectangular apertures 24 and welded or otherwise secured to the longitudinal beams (E), thus forming forklift pockets to receive the tine of a lifting fork. A subfloor 26 may lay on top of the joists (J) for supporting the fluid storage vessel 100.

Figure 12:
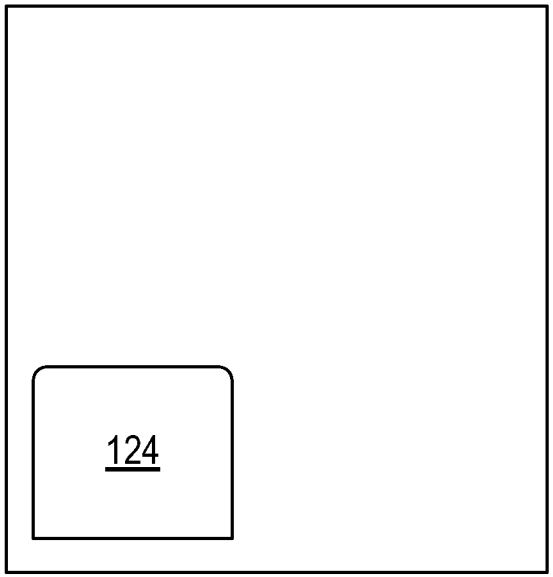
FIG. 12 is a detail of the front tank plate.
Figure 11:
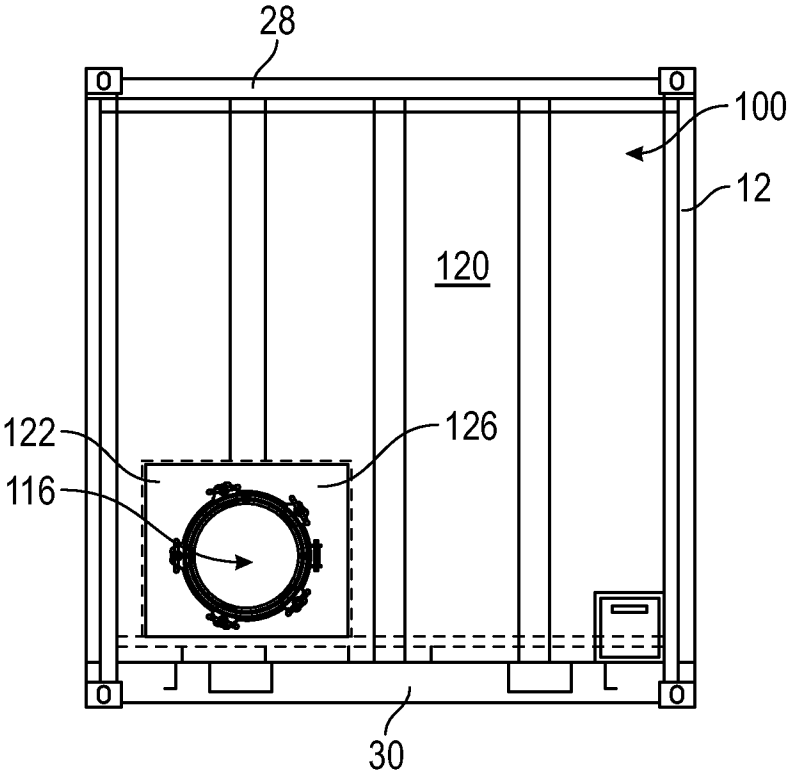
FIG. 11 is a front elevation similar to that shown in FIG. 4.
Figure 21:
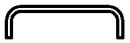
FIG. 21 is a detail of the vertical support channels.

With reference to FIGS. 11 and 12, the front wall structure 120 of the fluid storage vessel 100 includes a front wall plate (A) which is welded or otherwise secured to the frame assembly 12. A plurality of vertical stringers (B, C) extend between the longitudinal header 28 and longitudinal beam 30 and are welded or otherwise secured to the front wall plate (A). A cross-section of the vertical stringers (B, C) is shown in FIG. 21. The plate (A) and stringer (B,C) construction provides a reinforced front wall structure 120 for containing fluids within the fluid storage vessel 100.

Figure 19:
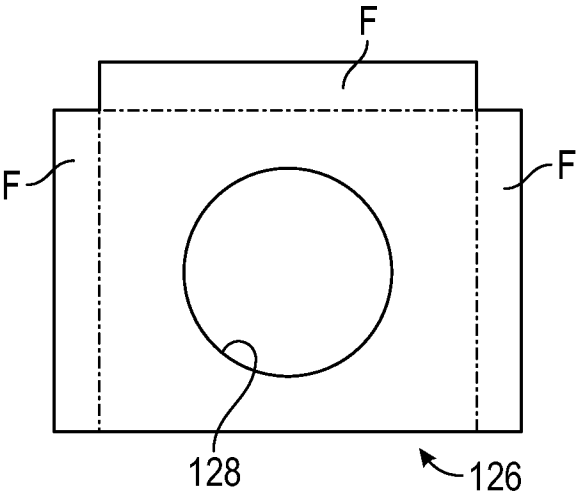
FIG. 19 is a detail of the manway plate shown in FIG. 11.
Figure 29:
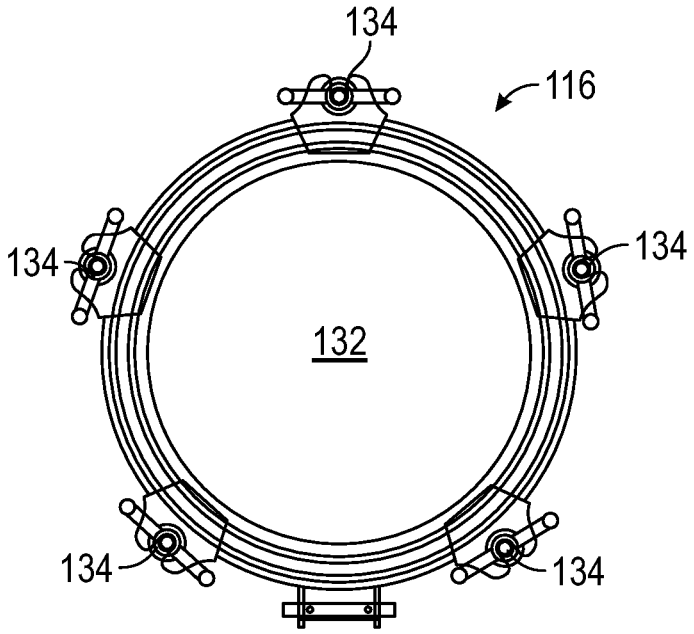
FIG. 29 is a detail showing a front elevation of the manway block configured to be mounted to the manway plate shown in FIG. 19.
Figure 30:
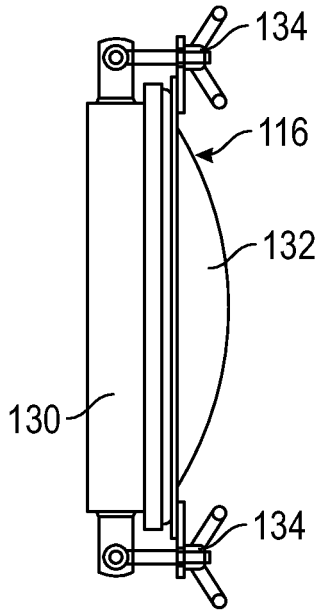
FIG. 30 is a side elevation of the manway block shown in FIG. 29.

As previously noted, the front side 112 includes a manway block 116. The manway block 116 is supported within a recess 122 formed in the front wall structure 112. The recess 122 is arranged in an aperture 124 formed in the front wall plate (A). Specifically, a manway plate 126 is welded or otherwise secured in the aperture 124 to form the recess 122. As best seen in FIG. 19, the manway plate 126 has an aperture 128 formed in a central portion and receives the manway block 116. Flanges (F) formed along the lateral sides and top of the manway plate 126 may be bent or otherwise formed along the broken lines to provide a shoulder between the front wall plate (A) and the central portion of the manway plate 126. With reference to FIGS. 29-30, the manway block 116 includes a collar 130 configured to be sealably secured to the manway plate 126. A cover 132 is hingedly coupled to the collar 130 and secured thereon by a plurality of threaded coupling elements 134.

Figure 14:
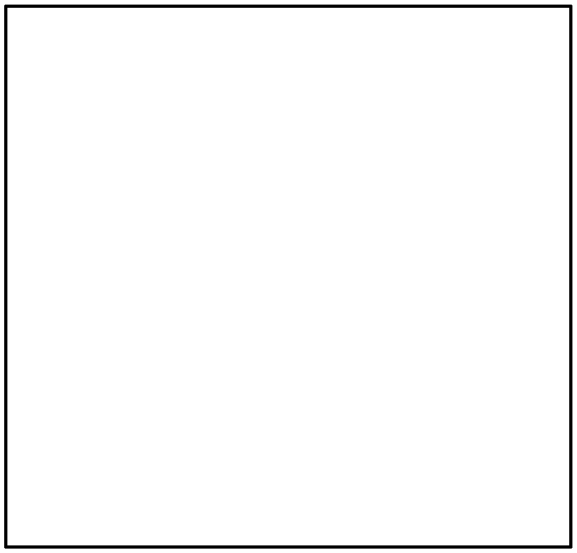
FIG. 14 is a detail of the rear tank plate.
Figure 13:
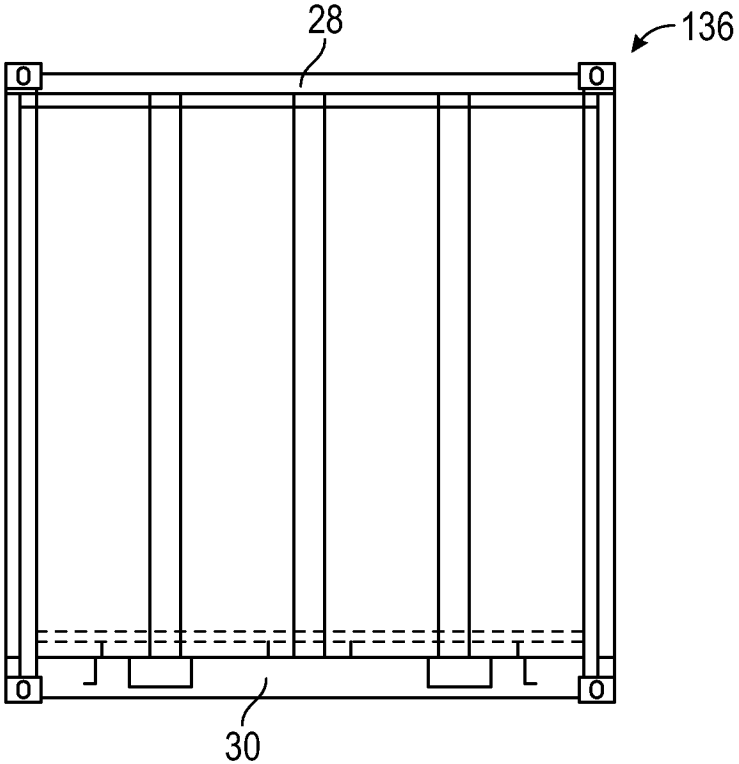
FIG. 13 is a rear elevation similar to that shown in FIG. 6.

With reference to FIGS. 13 and 14, the rear wall structure 136 of the fluid storage vessel 100 includes a rear wall plate (A) which is welded or otherwise secured to the frame assembly 12. A plurality of vertical stringers (B) extend between the longitudinal header 28 and longitudinal beam 30 and are welded or otherwise secured to the front wall plate (A). A cross-section of the vertical stringer (B) is shown in FIG. 21. The plate (A) and stringer (B) construction provides a reinforced rear wall structure 136 for containing fluids within the fluid storage vessel 100.

Figure 16:
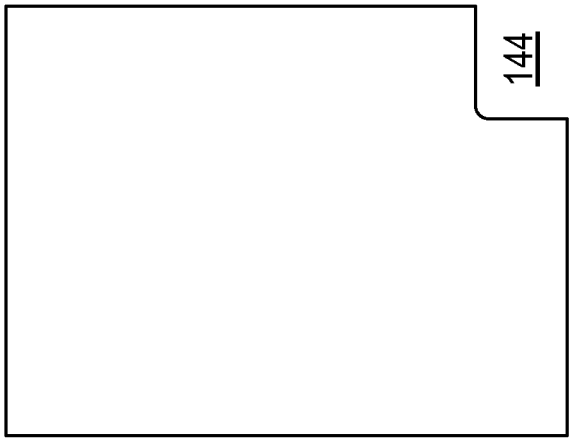
FIG. 16 is a detail of the right side tank plate.
Figure 15:
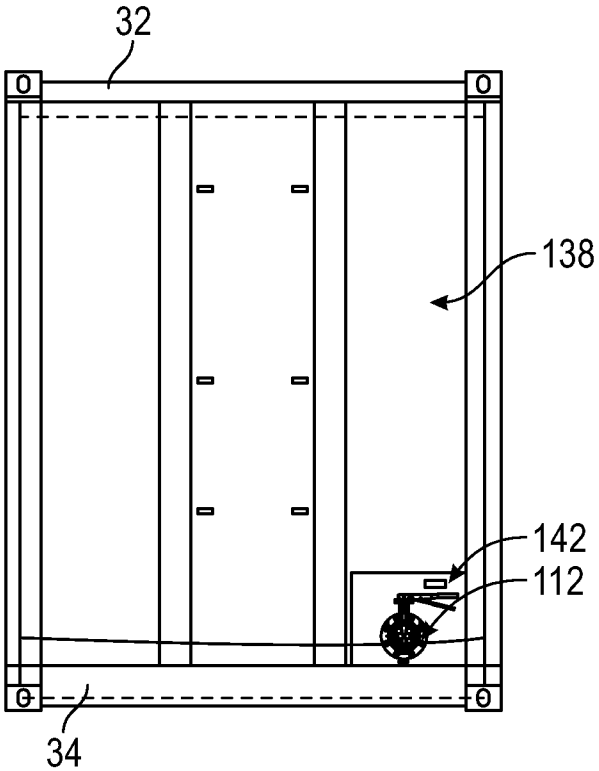
FIG. 15 is a right side elevation similar to that shown in FIG. 5.
Figure 18:
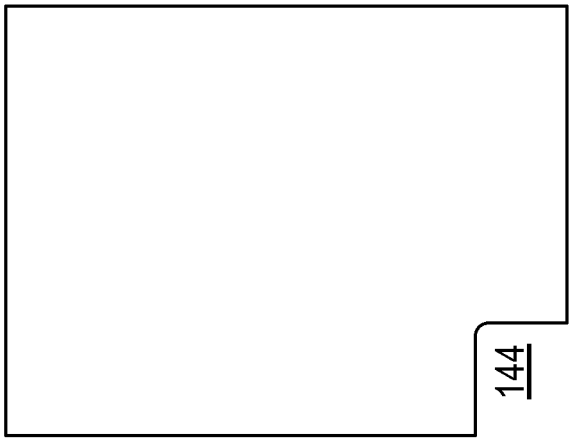
FIG. 18 is a detail of the left side tank plate.
Figure 17:
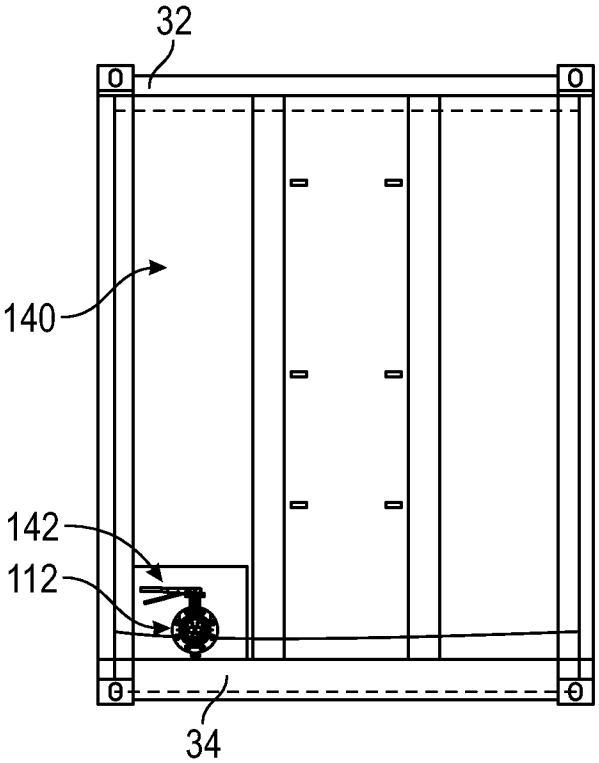
FIG. 17 is a left side elevation similar to that shown in FIG. 3.

FIGS. 15-16 illustrates a right wall structure 138 of the fluid storage vessel 100. FIGS. 17-18 illustrate a left wall structure of the fluid storage vessel 100. Since the left wall structure 140 is a complementary (i.e. a mirror image) component of the right wall structure 138, the features of the structure will be described simultaneously with like reference numbers representing the same or similar parts. The wall structures 138, 140 include a side wall plate (A) which is welded or otherwise secured to the frame assembly 12. A plurality of vertical stringers (B) extend between the transverse header 32 and transverse beam 34 and are welded or otherwise secured to the front wall plate (A). A cross-section of the vertical stringer (B) is shown in FIG. 21. The plate (A) and stringer (B) construction provides a reinforced front wall structure 138, 140 for containing fluids within the fluid storage vessel 100. Ladder brackets (C) may be welded or otherwise secured to the wall plate (A) and are configured for securing ladder rungs (not shown) to the fluid storage vessel 100.

Figure 20:
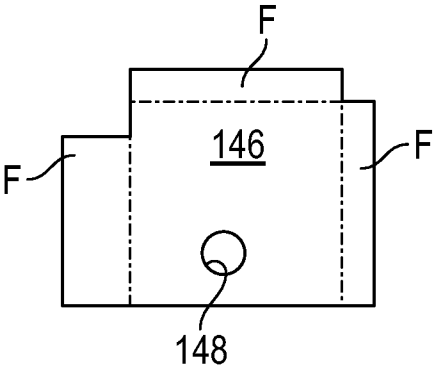
FIG. 20 is a detail of the valve plate shown in FIGS. 15 and 17.
Figure 31:
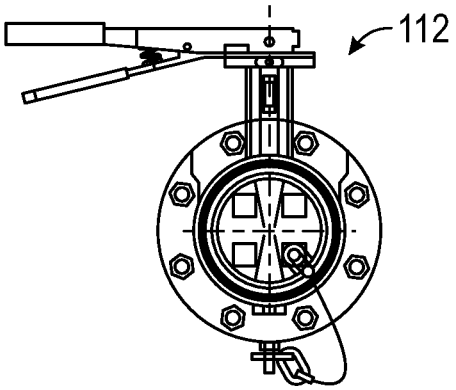
FIG. 31 is a detail showing a front elevation of the floor drain assembly configured to be mounted to the valve plate shown in FIG. 20.
Figure 32:
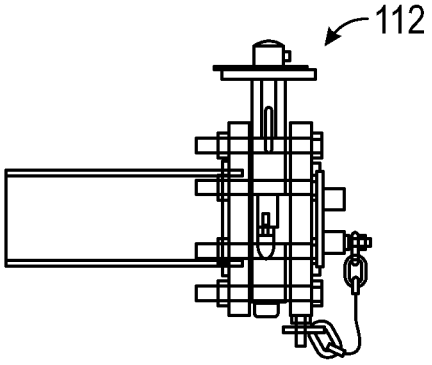
FIG. 32 is a side elevation of the floor drain assembly shown in FIG. 31.

As previously noted, the right side 108 and left side 110 include a drain valve assembly 112. The drain valve assembly 112 is supported within a recess 142 formed in the side wall structures 138, 140. The recess 142 is arranged in an aperture 144 formed in the side wall plate (A). Specifically, a valve plate 146 is welded or otherwise secured in the aperture 144 to form the recess 142. As best seen in FIG. 20, the valve plate 146 has an aperture 148 formed in a central portion and receives the drain valve assembly 112. Flanges (F) formed along the lateral sides and top of the valve plate 146 may be bent or otherwise formed along the broken lines to provide a shoulder between the side wall plate (A) and the central portion of the valve plate 146. With reference to FIGS. 31 and 32, the drain valve assembly 112 includes an inner circular flanges (B) secured to the side wall structure 128, 130, a butterfly valve (C) secured between the inner circular flange (B) and an outer circular flange (D) with threaded fasteners (E). A nipple (A) which is configured to be received within an interior volume of the fluid storage vessel 100 extends into an inlet of the butterfly valve (B). A cover (F) is removably disposed over an outlet of the butterfly valve (B) and tethered to the drain valve assembly 112 by a shackle (G) and chain (H).

Figure 23:
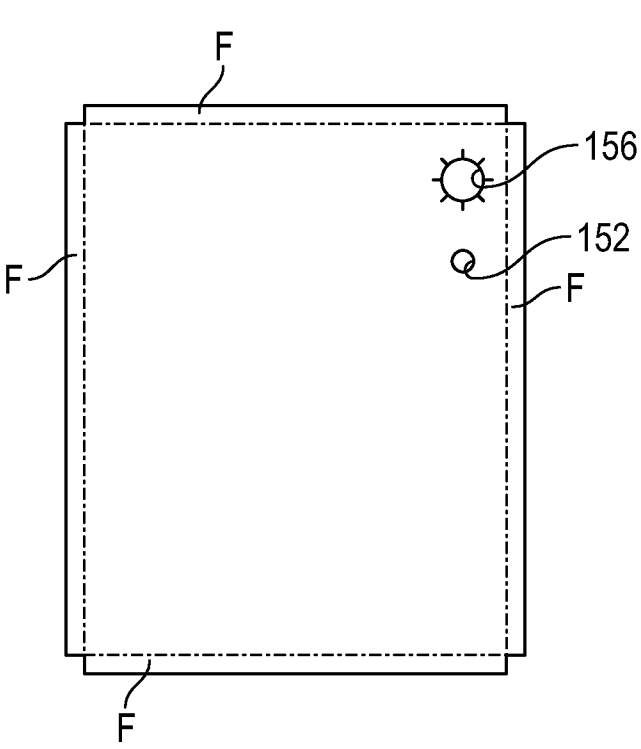
FIG. 23 is a detail of the top tank plate.
Figure 22:
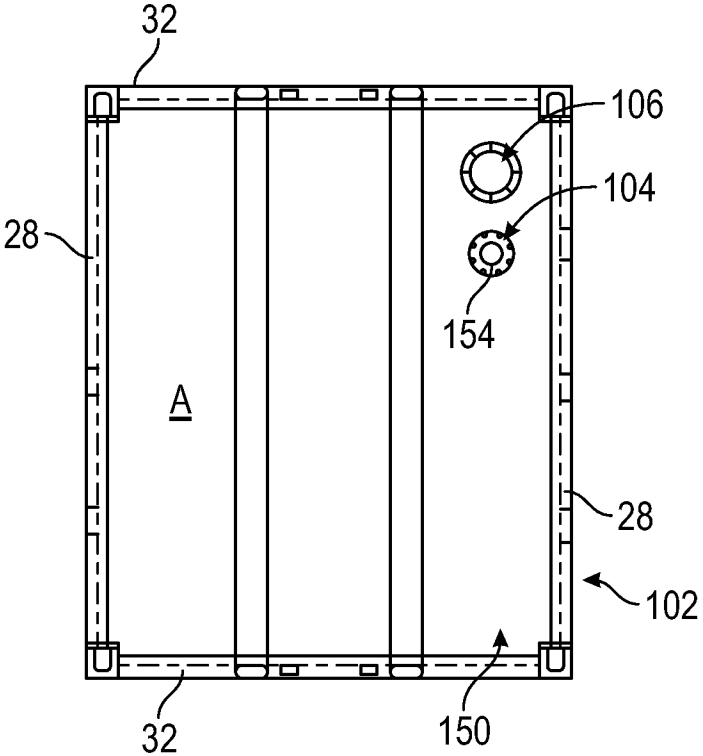
FIG. 22 is a top view similar to FIG. 2.

With reference to FIGS. 22 and 23, the top wall structure 150 of the fluid storage vessel 100 includes a top plate (A) which is welded or otherwise secured to the frame assembly 12. A plurality of longitudinal stringers (B) extend between the transverse headers 32 and are welded or otherwise secured to the top wall plate (A). A cross-section of the longitudinal stringer (B) is shown in FIG. 21. The top plate (A) and stringer (B) construction provides a reinforced top wall structure 150 for containing fluids within the fluid storage vessel 100. Flanges (F) formed along the longitudinal and transverse sides of the top plate (A) may be bent or otherwise formed along the broken lines to provide a flange for welding or otherwise securing the top wall structure 150 to the front, rear and side wall structures 120, 136 138, 140.

As previously noted, the top 102 includes a fill port 104 and a pressure vacuum valve 106. Specifically, the top plate (A) has aperture 152 formed therein, which receives a flanged filler neck 154, and aperture 156 formed therein, which receives the pressure vacuum valve 106. The filler neck 154 is configured to releasably couple with a fluid supply source via a hose, pipe or similar fluid supply element. The pressure vacuum valve 106 is configured to vent the air head space within the interior volume of the fluid storage vessel 100 during filling and draining operations.

Figure 25:
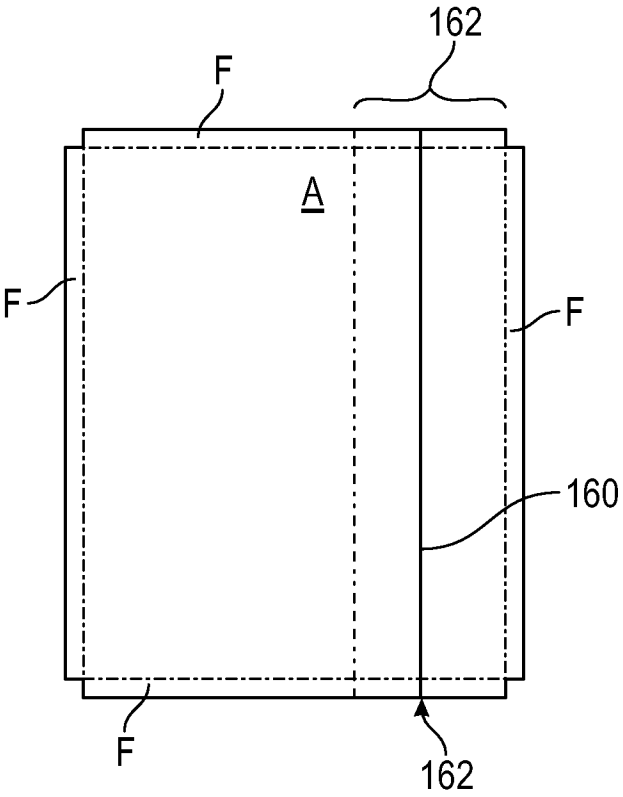
FIG. 25 is a detail of the bottom tank plate.
Figure 24:
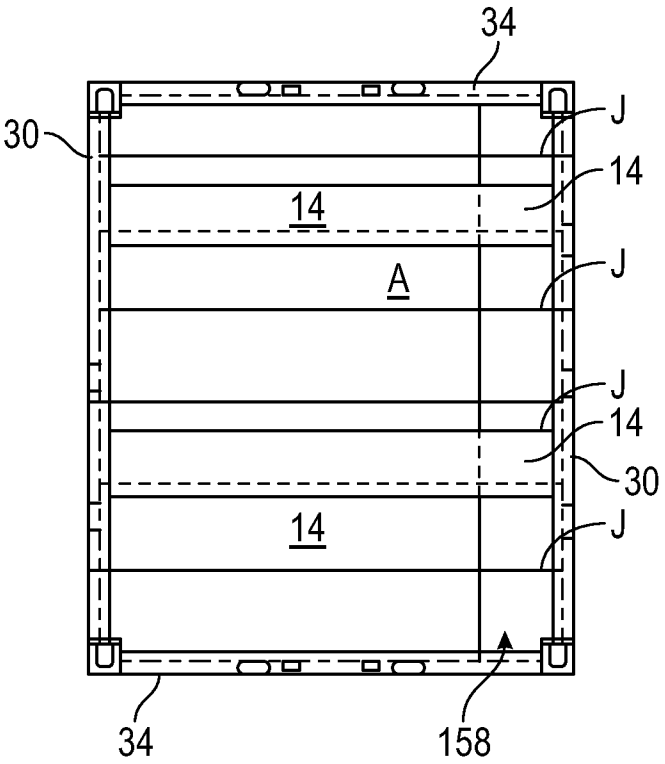
FIG. 24 is a bottom view of the bulk fluid storage container shown in FIG. 1.

With reference to FIGS. 24 and 25, the bottom wall structure 158 of the fluid storage vessel 100 includes a bottom plate (A) which is welded or otherwise secured to the frame assembly 12. Flanges (F) formed along the longitudinal and transverse sides of the top plate (A) may be bent or otherwise formed along the broken lines to provide a flange with welding or otherwise securing the bottom wall structure 158 to the front, rear and side wall structures 120, 136 138, 140. The bottom plate (A) is bent at break line 160 to form a valley or gutter region 162 which corresponds to the low point 22 formed in joists (J) shown in FIG. 8. The nipple (A) on the drain valve assembly 112 is situated in the gutter region 162 of the bottom wall structure 158. The pitched configuration of the bottom wall plate (A) ensures that fluid can be substantially completely drained from the fluid storage vessel 100.

Figure 28:
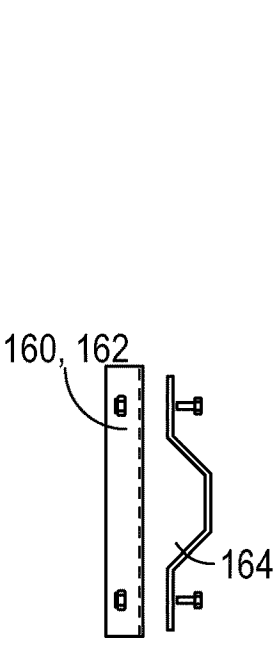
FIG. 28 is an expanding view showing a baffle and baffle mounting plate.
Figure 27:
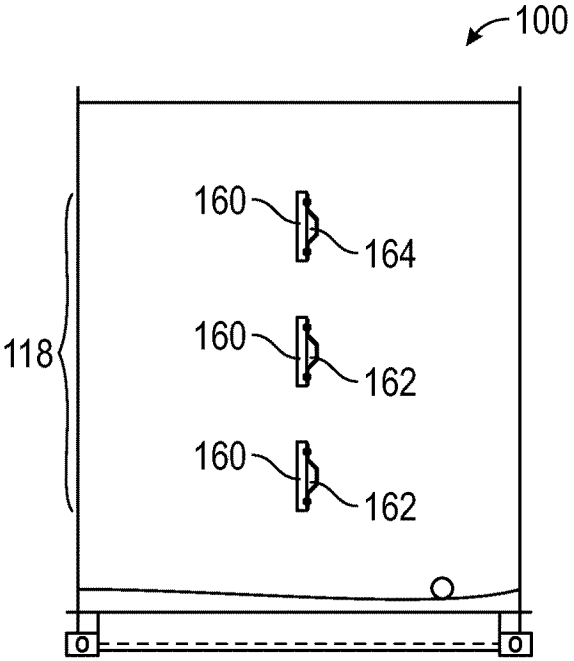
FIG. 27 is a cross-section take at B-B shown in FIG. 26 showing the internal baffle assembly.
Figure 26:
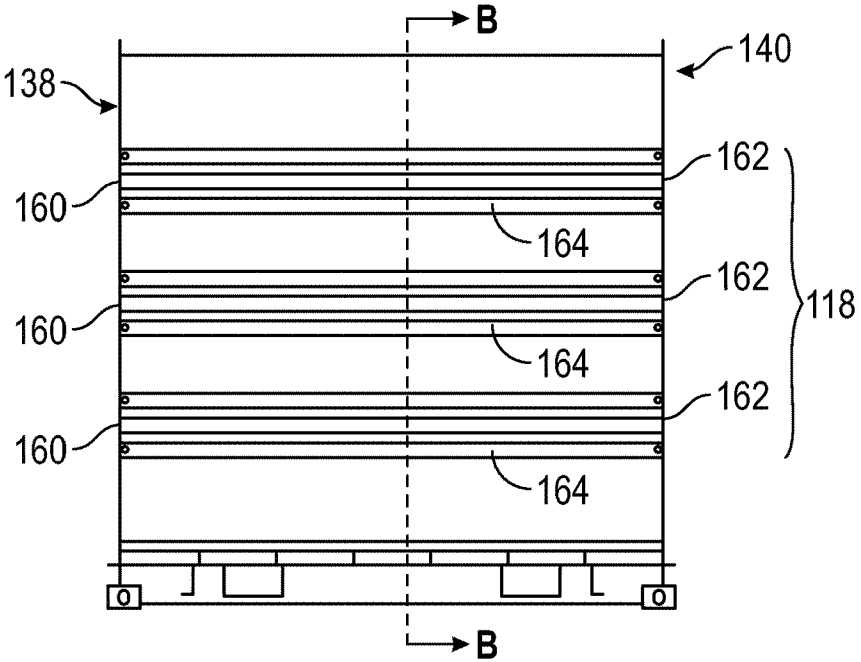
FIG. 26 is a cross-section taken at A-A shown in FIG. 5 showing the internal baffle assembly.

With reference now to FIGS. 26-28, the fluid storage vessel 100 includes an internal baffle assembly 118 for reducing fluid sloshing when the bulk fluid storage container 100 is moved and/or transported. In this regard, Applicant has determined that side-to-side wave motion is more likely to result in unwanted sloshing of fluid and potential for tipping of the bulk fluid storage container 100 then fore-aft wave motion. Accordingly, the internal baffle assembly 118 is arranged longitudinally within the interior volume of the fluid storage vessel 100. The baffle assembly 118 includes mounting brackets 160, 162 welded or otherwise secured to the wall plate on the left and right side wall structures 138, 140, respectively. The ends of baffle plate 164 are secured to the mounting brackets 160, 162 such that the baffle plates 164 extend between the right and left wall structures 138, 140. As best seen in FIG. 28, each baffle plate 164 has a hat-shaped cross-section to increase the second moment of area (with respect to a flat plate) thereby decreasing deflection and induced stress of the baffle plate 164 under a given load.

While a hat-shaped cross-section is illustrated in the drawings, one skilled in the art will understand that other cross-sectional configurations may to implemented to increase the second moment of area of the baffle plate 164. As illustrated in FIG. 26, the baffle assembly 118 includes three baffle plates 164 arranged in a spaced relation in the interior volume of the fluid storage vessel 100. However, the present disclosure contemplates the use of one or more baffle plates 164 within the fluid storage vessel 100. In this regard, Applicant notes that the most detrimental effects resulting from fluid sloshing occur when the fluid storage vessel 100 is approximately 40% full. Accordingly, positioning one or more baffle plates 164 within the lower 40% of the interior volume for the fluid storage vessel 100 has beneficial impact to reduce the detrimental effects resulting from fluid sloshing.

While at least one exemplary embodiment has been presented in the foregoing detailed description, it should be appreciated that a vast of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

What is claimed is:

1. A bulk fluid storage container comprising:

a frame assembly including an upper rectangular frame member and a lower rectangular frame member arranged in spaced relation by a plurality of post;

a fluid storage vessel defining an interior volume for storing a fluid including:

a front wall structure and a rear wall structure held in spaced relation by right and left side wall structures and top and bottom wall structures;

a first port disposed in an upper region of the fluid storage vessel and in fluid communication with the interior volume thereof for filling the interior volume with a fluid;

a second port disposed in the fluid storage vessel and in fluid communication with the interior volume thereof for venting the interior volume to maintain an atmospheric pressure therein;

a third port disposed in the fluid storage vessel and in fluid communication with the interior volume thereof for draining the interior volume of the fluid; and an internal baffle assembly in the fluid storage volume between the left and the right side wall structures for reducing fluid sloshing and stabilizing the bulk fluid storage container when transported in at least a partially filled condition;

wherein the frame assembly surrounds and supports the fluid storage vessel.

2. The bulk fluid storage container according to claim 1, wherein the bottom wall structure comprises a bottom plate having a gutter region formed therein and the third port is located in a lower region of the interior volume of the fluid storage vessel adjacent the gutter region, wherein a drain valve assembly is coupled to the third port.

3. The bulk fluid storage container according to claim 1, wherein the fluid storage vessel has a recessed wall structure forming a pocket in a lower region of the fluid storage vessel, wherein third port is formed in the recessed wall structure and a drain valve assembly is coupled to the third port in the pocket.

4. The bulk fluid storage container according to claim 1, wherein the lower frame member comprises a pair of tubular members extending transversely between a pair of longitudinal rails, wherein the tubular members are configured to receive tines of a lifting fork.

5. The bulk fluid storage container according to claim 1, further comprising a first flange provided in the first port and configured to couple with a source of the fluid.

6. The bulk fluid storage container according to claim 1, further comprising a pressure vacuum value operable coupled to the second port.

7. The bulk fluid storage container according to claim 1, wherein the internal baffle assembly further comprises:

a first mounting bracket secured to the left side wall structure;

a second mounting bracket secured to the right side wall structure; and a baffle plate having a first end secured to the first mounting bracket and a second end secured to the second mounting bracket.

8. The bulk fluid storage container according to claim 1, wherein the internal baffle assembly comprises at least one baffle plate extending between the left and right wall structure, wherein the baffle plate has a structural feature formed therein for increasing the second moment of area with respect to a flat plate.

9. The bulk fluid storage container according to claim 8, wherein the structural feature comprises a hat-shaped cross section.

10. The bulk fluid storage container according to claim 1, further comprising a manway assembly with a manway plate secured around an aperture formed in the fluid storage vessel and a manway block having a collar sealably secured to the manway plate and a cover hingedly coupled to the collar.

11. The bulk fluid storage container according to claim 10, wherein the fluid storage vessel has a recessed wall structure forming a pocket therein, wherein the aperture is formed in the recessed wall structure and the manway block is disposed in the pocket.

12. The bulk fluid storage container according to claim 1, further comprising a manway assembly with a manway plate secured around an aperture formed in the fluid storage vessel and a manway block having a collar sealably secured to the manway plate and a cover hingedly coupled to the collar.

13. The bulk fluid storage container according to claim 12, wherein the fluid storage vessel has a recessed wall structure forming a pocket therein, wherein the aperture is formed in the recessed wall structure and the manway block is disposed in the pocket.

14. A bulk fluid storage container comprising:

a fluid storage vessel defining an interior volume for storing a fluid including:

a top wall structure and a bottom wall structure held in spaced relation by a side wall structure including right and left side walls and front and rear side walls, wherein the bottom wall has a gutter region formed therein;

an internal baffle assembly in the fluid storage volume between the side wall structure for reducing fluid sloshing and stabilizing the bulk fluid storage container when the bulk fluid storage container is transported in at least a partially filled condition;

a fill port formed in the top wall structure and in fluid communication with the interior volume;

a vent port formed in the top wall structure and in fluid communication with the interior volume;

a drain port formed in the side wall structure in a lower region adjacent the gutter region and in fluid communication with the interior volume;

a fill flange provided in the fill port and configured to couple with a source of the fluid;

a pressure vacuum value operable coupled to the vent port;

a drain valve assembly is coupled to the drain port; and a frame assembly including an upper rectangular frame member and a lower rectangular frame member arranged in spaced relation by a plurality of post; wherein the frame assembly surrounds and supports the fluid storage vessel.

15. The bulk fluid storage container according to claim 14, wherein the side wall structure comprises a recessed wall forming a pocket in the lower region of the fluid storage vessel and the drain port is formed in the recessed wall structure such that the drain valve assembly is coupled to the drain port in the pocket.

16. The bulk fluid storage container according to claim 14, wherein the internal baffle assembly further comprises:

a first mounting bracket secured to the left side wall structure;

a second mounting bracket secured to the right side wall structure; and a baffle plate having a first end secured to the first mounting bracket and a second end secured to the second mounting bracket.

17. The bulk fluid storage container according to claim 14, wherein the internal baffle assembly comprises at least one baffle plate extending between the left and right wall structure, wherein the baffle plate has a structural feature formed therein for increasing the second moment of area with respect to a flat plate.

18. The bulk fluid storage container according to claim 17, wherein the structural feature comprises a hat-shaped cross section.

19. The bulk fluid storage container according to claim 14, wherein the lower frame member comprises a pair of tubular members extending transversely between a pair of longitudinal rails, wherein the tubular members are configured to receive tines of a lifting fork.

* * * * *